US005775963A

United States Patent [19]

Byfield, Jr.

[11] Patent Number: 5,775,963

[45] Date of Patent: Jul. 7, 1998

[54] MALE-TYPE ELECTRICAL TERMINAL

[75] Inventor: Dwight Byfield, Jr., Fresno, Calif.

[73] Assignee: WirthCo Engineering, Inc., Bloomington, Minn.

[21] Appl. No.: 790,646

[22] Filed: Jan. 29, 1997

[51] Int. Cl.[6] ..... H01R 13/04

[52] U.S. Cl. ..... 439/884

[58] Field of Search ..... 439/884, 885, 439/886, 887, 888, 889, 890, 841, 845, 850

[56] References Cited

U.S. PATENT DOCUMENTS 3,422,395 1/1969 Fisher ..... 439/884

4,764,133 8/1988 Kaneko ..... 439/884

5,591,054 1/1997 Okada et al. ..... 439/884

FOREIGN PATENT DOCUMENTS

94/09532 4/1994 WIPO ..... 439/884

*Primary Examiner*—Neil Abrams

*Assistant Examiner*—Tho D. Ta

*Attorney, Agent, or Firm*—Roger W. Jensen

[57] ABSTRACT

A male-type terminal end portion comprising a relatively thin, flat metal strip having two sides and a proximal end and a plurality of longitudinally spaced apart indentations extending along the longitudinal axis to the proximal end. The indentations have a preselected depth to thus form an effective thickness equal to the sum of the preselected depth and preselected thickness of the metal strip.

6 Claims, 1 Drawing Sheet

MALE-TYPE ELECTRICAL TERMINAL

BACKGROUND OF THE INVENTION

This invention relates to the field of electrical connectors (a very broad and highly developed field) and more specifically to very small or miniature male-type electrical connectors, an example of which is shown in my co-pending application Ser. No. 08/791,727 filed Jan. 29, 1997 and entitled "ELECTRICAL CONNECTOR FOR TAPPING INTO A FUSE BLOCK". In the field of tapping into fuse blocks, it is very important to have the tap formed from relatively thin stock material so as to not overstress the female connector coacting with the flat fuse, all as is well understood by those skilled in the art. As a specific example, it is advantageous to use hardened brass stock material having a nominal thickness of 0.016 inches for the tap. However, material this thin does not provide sufficient stiffness at the male connector end thereof for coacting with a female connector.

The present invention provides a unique male terminal end for a terminal that increases significantly the effective thickness of the male-type terminal end portion of the terminal. In the preferred embodiment of the invention, the thickness of the male terminal end is effectively doubled but this can be decreased or increased according to the application. Also, while the present invention is depicted in combination with a fuse block tap, it will be understood that the invention has numerous other applications.

SUMMARY OF THE INVENTION

A male-type terminal end portion (of a complete electrical terminal) is shaped so as to be received by a female-type terminal and is fabricated from a relatively thin, flat conductive strip having a preselected thickness, mutually perpendicular longitudinal and transverse axes, a preselected transverse width defined by two sides respectively parallel to said longitudinal axis and a proximal end. The male-type terminal end portion is further characterized by having a plurality of longitudinally spaced apart indentations extending along the longitudinal axis to the proximal end. The indentations each have a preselected depth to thus create an effective thickness of the male-type terminal end portion equal to the sum of the preselected depth and said preselected thickness of the metal strip. In the preferred embodiment, each of the indentations has a preselected depth approximately equal to the preselected thickness of the metal strip to thus create an effective thickness of the male-type connector end portion approximately double said preselected thickness of the metal strip.

The indentations extend generally transversely to the longitudinal axis. In the preferred embodiment, the indentations (when viewed in plan view) have a V-shape, i.e., the indentations start at the center line or longitudinal axis, and are sloped symmetrically away from the longitudinal axis to the sides of the terminal portion, the slope being away from the proximal end. The aforesaid V-shape produces a chevron-like appearance and is very important from the standpoint of providing increased stiffness to the terminal end portion.

DETAILED DESCRIPTION OF THE INVENTION

Figure 1:
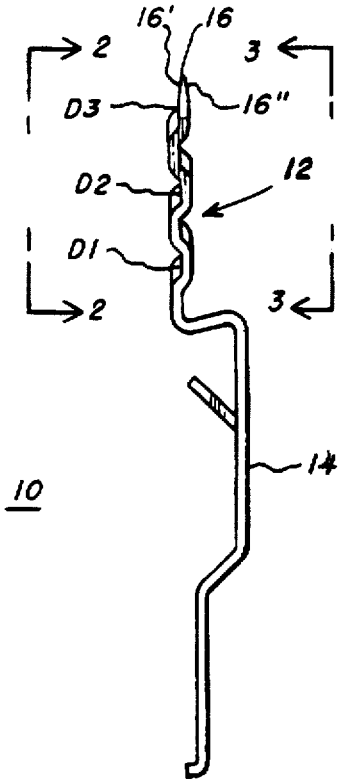
FIG. 1 shows a side view of an electrical terminal 10 which is the subject matter of my aforesaid co-pending patent application Ser. No. 08/791,727 filed Jan. 29, 1997 and which comprises in part my unique male-type terminal end portion which is the subject matter of this application.
Figure 2:
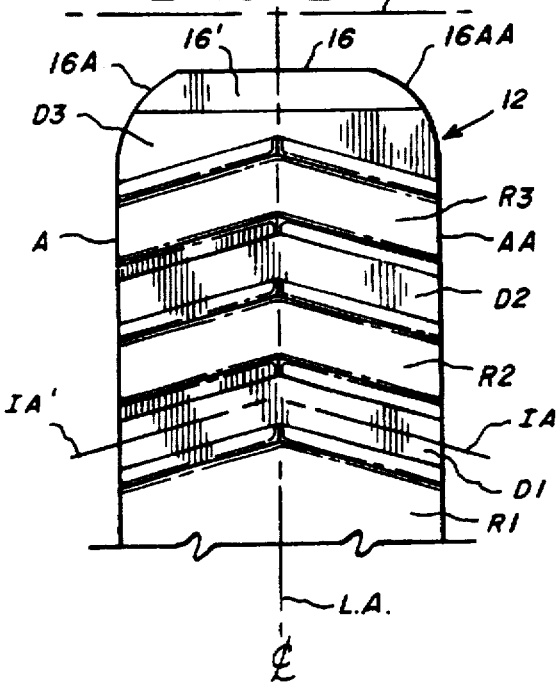
FIG. 2 is an enlarged plan view of the unique male-type terminal end portion as viewed along section lines 2—2 of FIG. 1.

Referring to FIG. 1, connector 10 comprises a male-type terminal end portion 12 shaped to be received by a female-type terminal (not shown). The entire terminal 10 is made out of a continuous strip of relatively thin, flat conductive material 14 having a preselected thickness X (see FIG. 4), mutually perpendicular longitudinal and transverse axes LA and TA respectively (see FIG. 2). The longitudinal axis LA as shown in FIG. 2 is centered and thus may be considered as a center line for the male-type terminal end portion 12. The end portion 12 has a preselected transverse width defined by two sides, A and M respectively, parallel to the longitudinal axis, and a proximal end 16. As viewed in FIGS. 2 and 3, it will be noted that the proximal end has curved portions 16A and 16AA connecting to sides A and M respectively. Also, in the preferred embodiment, the proximal end 16 has tapered sides 16' and 16" (see FIG. 1) to facilitate coaction with the aforesaid female type terminal. Further, in the preferred embodiment, the material 14 is hardened brass having a nominal thickness of 0.016 inches.

The end portion 12 is further characterized by having a plurality of longitudinally spaced apart indentations D1, D2 and D3, extending along the longitudinal axis LA toward the proximal end 16. Reference sections R1, R2 and R3 (shown in FIGS. 2–4), adjacent respectively to indentations D1, D2 and D3, represent the original plane of the metallic strip 14 prior to the making of the indentations.

Figure 3:
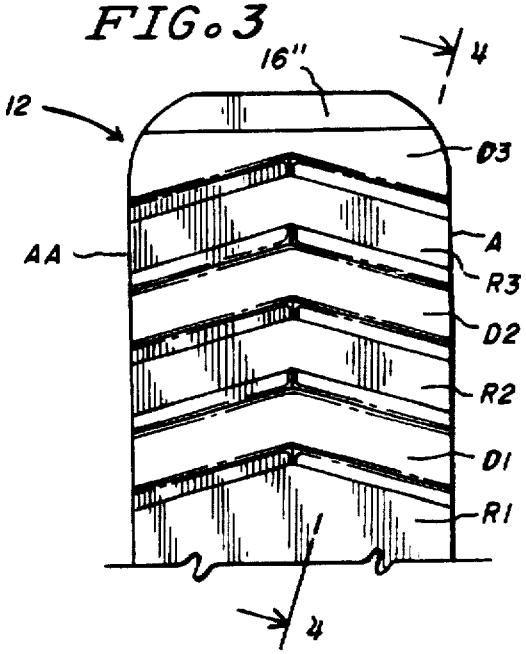
FIG. 3 is an enlarged plan view of the unique male-type terminal end portion as viewed along section lines 3—3 of FIG. 1.

In the preferred embodiment, the indentations D1–D3 have a V-shaped appearance or chevron appearance in the plan views depicted in FIGS. 2 and 3. Thus, for example, indentation D1 (starting at the center line or longitudinal axis LA) slopes both toward side A and side AA (away from the proximal end 16) symmetrically along indentation axes IA and IA'. Thus, the indentation axes IA and IA' for the indentation D1 are sloped symmetrically away from the longitudinal axis both transversely and away from the proximal end. The slope depicted in FIGS. 2 and 3 is approximately 18 degrees from the transverse axis TA, but those skilled in the art will understand that the slope angle can be varied. It is important to have, at least for some applications, the described slope of the indentations to produce the V-shape or chevron appearance so as to produce a greater stiffness in the male end portion as compared to the indentations being parallel to the transverse axis. Thus the scope of the invention should be understood to include the indentations being parallel to the transverse axis for some applications and to be sloped, as aforesaid, in other applications to produce a chevron type appearance as is depicted in FIGS. 2 and 3.

Figure 4:
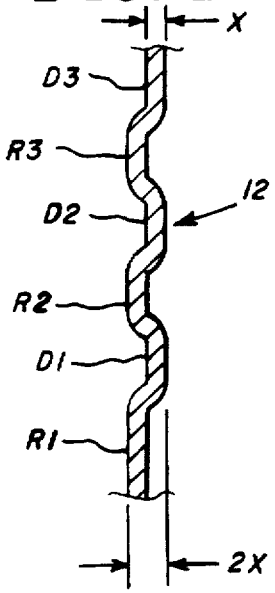
FIG. 4 is a cross-section of the terminal end portion as viewed along section lines 4—4 of FIG. 3.

FIG. 4 depicts a cross-section of the end portion for the preferred embodiment showing clearly the reference surfaces R1–R3 and the three indentations D1–D3, the indentations having a depth approximately equal to the thickness X of the brass stock 14. This results in the effective thickness of the member as depicted being 2×, i.e., twice the thickness X of the basic material 14.

Those skilled in the art will recognize that the indentations D1–D3 may have an effective depth greater than or less than the thickness X of the material. In the preferred embodiment, as stated above, hardened brass stock having a thickness of 0.016 inches is used and, by having the indentations D1–D3 approximately the same as said thickness, the resultant effective thickness of the male-type terminal end portion is twice 0.016 inches or 0.032 inches; this is an effective thickness which is advantageous for use as a male terminal for coaction with a female terminal.

While several embodiments of the invention have been illustrated, it will be understood that variations may be made by those skilled in the art without departing from the inventive concept. Accordingly, the invention is to be limited only by the scope of the following claims.

What is claimed as my invention is:

1. An electrical terminal having a male-type terminal end portion shaped to be received by a female-type terminal, said male-type terminal end portion comprising a relatively thin, flat conductive metal strip having a preselected thickness;

mutually perpendicular longitudinal and transverse axes, a preselected transverse width defined by two sides respectively parallel to said longitudinal axis and a proximal end, said male-type terminal end portion further being characterized by having a plurality of longitudinally spaced apart indentations extending along said longitudinal axis toward said proximal end, said indentations each having a preselected depth to thus create an effective thickness of said male-type terminal end portion equal to the sum of said preselected depth and said preselected thickness of said metal strip; and each of said indentations extending from said longitudinal axis to said sides in two sections having preselected non-parallel axes.

2. The terminal of claim 1 further characterized by said preselected axes being sloped away from said proximal end.

3. An electrical terminal having a male-type terminal end portion shaped to be received by a female-type terminal, said male-type terminal end portion comprising a relatively thin, flat conductive metal strip having a preselected thickness;

mutually perpendicular longitudinal and transverse axes, a preselected transverse width defined by two sides respectively parallel to said longitudinal axis, and a proximal end, said male-type terminal end portion further being characterized by having a plurality of longitudinally spaced apart indentations extending along said longitudinal axis to said proximal end, said indentations each having a preselected depth approximately equal to said preselected thickness of said metal strip to thus create an effective thickness of said male-type terminal end portion approximately double said preselected thickness of said metal strip; and each of said indentations extending from said longitudinal axis to said sides in two sections having preselected non-parallel axes.

4. The terminal of claim 3 further characterized by said preselected axes being sloped away from said proximal end.

5. An electrical terminal having a male-type terminal end portion shaped to be received by a female-type terminal, said male-type terminal end portion comprising a relatively thin, flat conductive metal strip having a preselected thickness;

mutually perpendicular longitudinal and transverse axes, a preselected transverse width defined by two sides respectively parallel to said longitudinal axis and a proximal end, said male-type terminal end portion further being characterized by having a plurality of spaced apart indentations extending therealong, said indentations each having a preselected depth to thus create an effective thickness of said male-type terminal end portion equal to the sum of said preselected depth and said preselected thickness of said metal strip; and each of said indentations extending from said longitudinal axis to said sides in two sections having preselected non-parallel axes.

6. The terminal of claim 5 further characterized by said preselected axes being sloped away from said proximal end.

* * * * *